US012252164B2

(12) United States Patent
Xu et al.

(10) Patent No.: US 12,252,164 B2
(45) Date of Patent: Mar. 18, 2025

(54) OPERATION DIAGRAM-BASED METHOD FOR AUTOMATICALLY CHANGING ROUTE TO TURN BACK IN CASE OF INTERRUPTION

(71) Applicant: CASCO SIGNAL LTD., Shanghai (CN)

(72) Inventors: Jing Xu, Shanghai (CN); Honghui Yan, Shanghai (CN); Jiang Qian, Shanghai (CN); Tingliang Zhou, Shanghai (CN); Juan Xie, Shanghai (CN)

(73) Assignee: CASCO SIGNAL LTD., Shanghai (CN)

( * ) Notice: Subject to any disclaimer, the term of this patent is extended or adjusted under 35 U.S.C. 154(b) by 246 days.

(21) Appl. No.: 18/013,553

(22) PCT Filed: Nov. 4, 2021

(86) PCT No.: PCT/CN2021/128579

§ 371 (c)(1),
(2) Date: Dec. 29, 2022

(87) PCT Pub. No.: WO2022/100501

PCT Pub. Date: May 19, 2022

(65) Prior Publication Data

US 2023/0286558 A1 Sep. 14, 2023

(30) Foreign Application Priority Data

Nov. 16, 2020 (CN) ..... 202011279855.4

(51) Int. Cl.
*B61L 23/14* (2006.01)

(52) U.S. Cl.
CPC ..... *B61L 23/14* (2013.01)

(58) Field of Classification Search
CPC ..... B61L 23/14; B61L 27/04; B61L 27/12
See application file for complete search history.

(56) References Cited

U.S. PATENT DOCUMENTS 3,601,602 A * 8/1971 Smith ..... B61L 15/0094 246/124
7,343,314 B2 * 3/2008 Matheson ..... G06Q 10/047 706/41

(Continued)

FOREIGN PATENT DOCUMENTS

CN 110203257 B * 4/2020 ..... B61L 23/00
CN 111845869 A * 10/2020 ..... B61L 27/0022

OTHER PUBLICATIONS

241024 CN110203257B—Google Patents machine translation (Year: 2024).*

(Continued)

*Primary Examiner* — Carl C Staubach
(74) *Attorney, Agent, or Firm* — JCIPRNET

(57) ABSTRACT

The invention relates to an operation diagram-based method for automatically changing a route to turn back in case of interruption. The method obtains an alternative turn-back point according to the position of a fault point and the information of a line turn-back station, calculates a corresponding turn-back plan of the alternative turn-back point according to an operation diagram of the current day, and finally automatically changes an online train route according to the new turn-back plan, so as to realize automatic turn-back of a train after route adjustment in case of interruption. Compared with the prior art, the method has the advantage of being able to keep the compatibility with an existing operation diagram while quickly changing a route in case of partial line interruption, so as to facilitate quick recovery of planned operation after a fault is removed.

9 Claims, 1 Drawing Sheet

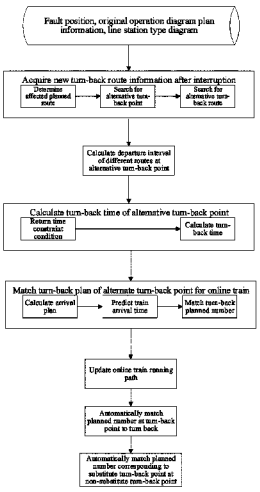

(56) References Cited

U.S. PATENT DOCUMENTS

| | | | | |
|---|---|---|---|---|
| 7,512,481 | B2 * | 3/2009 | Julich | G06Q 10/08 701/19 |
| 8,260,648 | B2 * | 9/2012 | Elazouni | G06Q 10/06 705/7.22 |
| 9,744,981 | B2 * | 8/2017 | Niinomi | B61L 27/16 |
| 10,023,162 | B2 * | 7/2018 | Shiratsuchi | B61L 25/025 |
| 11,531,942 | B2 * | 12/2022 | Su | G06Q 10/06312 |
| 11,731,674 | B2 * | 8/2023 | Su | B61L 27/10 701/19 |
| 12,037,034 | B2 * | 7/2024 | Indre | B61L 27/14 |
| 12,111,650 | B2 * | 10/2024 | Pei | B61L 27/40 |
| 2022/0188725 | A1 * | 6/2022 | Minakawa | B61L 27/16 |

OTHER PUBLICATIONS

241024 CN111845869A—Google Patents machine translation (Year: 2024).*

"International Search Report (Form PCT/ISA/210) of PCT/CN2021/128579", mailed on Jan. 26, 2022, with English translation thereof, pp. 1-5.

* cited by examiner

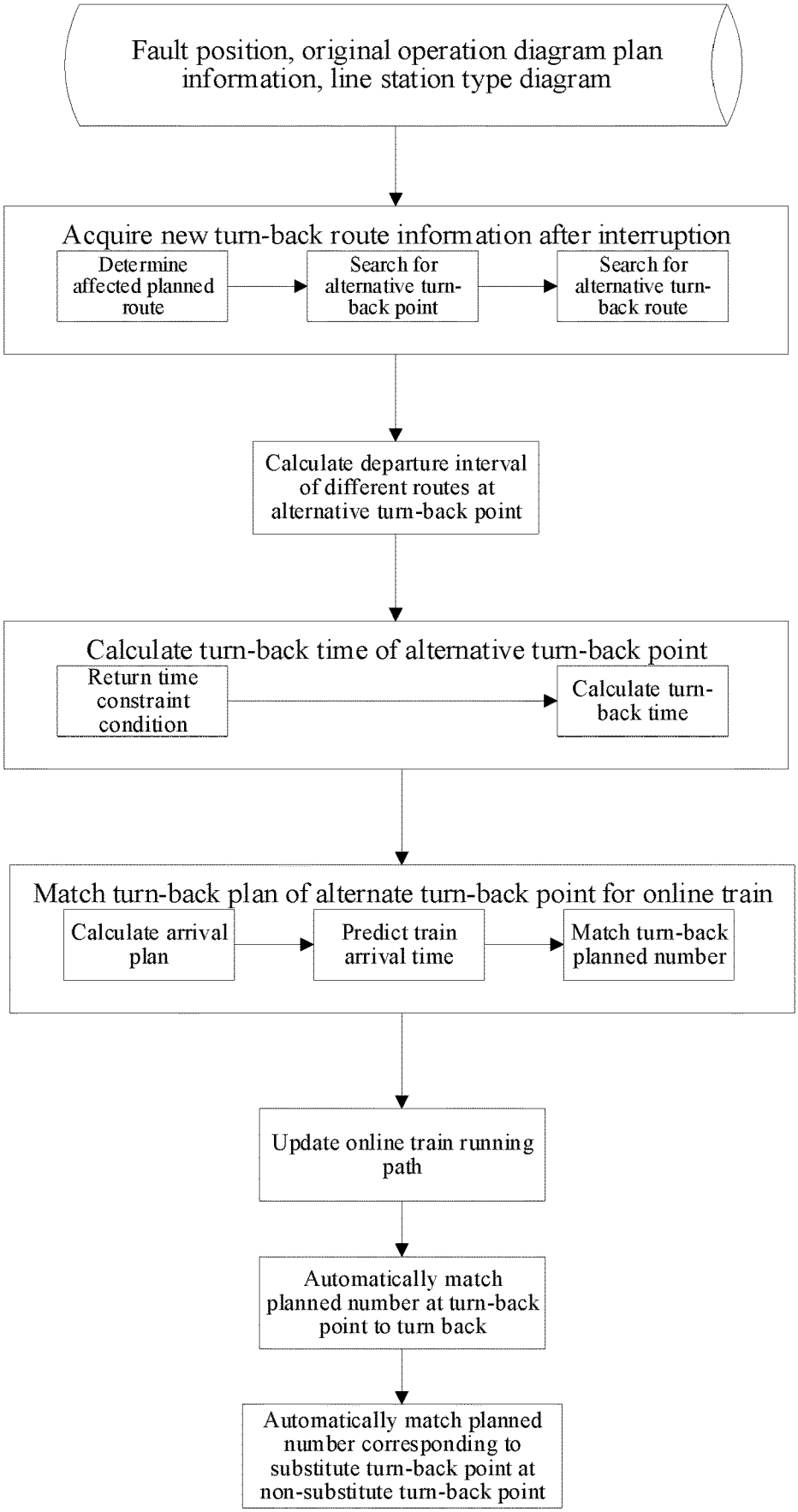
Fault position, original operation diagram plan information, line station type diagram
Acquire new turn-back route information after interruption
Determine affected planned route
Search for alternative turn-back point
Search for alternative turn-back route
Calculate departure interval of different routes at alternative turn-back point
Calculate turn-back time of alternative turn-back point
Return time constraint condition
Calculate turn-back time
Match turn-back plan of alternate turn-back point for online train
Calculate arrival plan
Predict train arrival time
Match turn-back planned number
Update online train running path
Automatically match planned number at turn-back point to turn back
Automatically match planned number corresponding to substitute turn-back point at non-substitute turn-back point

OPERATION DIAGRAM-BASED METHOD FOR AUTOMATICALLY CHANGING ROUTE TO TURN BACK IN CASE OF INTERRUPTION

CROSS-REFERENCE TO RELATED APPLICATION

This application is a 371 of international application of PCT application serial no. PCT/CN2021/128579, filed on Nov. 4, 2021, which claims the priority benefit of China application no. 202011279855.4, filed on Nov. 16, 2020. The entirety of each of the above mentioned patent applications is hereby incorporated by reference herein and made a part of this specification.

TECHNICAL FIELD

The invention relates to operation control of urban rail transit, in particular to an operation diagram-based method for automatically changing a route to turn back in case of interruption.

RELATED ART

Line interruption in urban rail transit refers to the phenomenon that some stations or sections are out of service due to unexpected events such as train collision, derailment, and failures and damage of facilities and equipment, which results in the destruction of road network connectivity. Sudden interruption greatly reduces the reliability and carrying capacity of subway operation and disrupts the travel plan of passengers, and if a passenger evacuation strategy cannot be adopted in time, accidents such as a stampede may be caused.

When interruption occurs to a subway, some lines become inaccessible. Generally, traffic organization will be adjusted in real time according to the line interruption situation. The adjustment strategies include the following:

- unilateral to-and-fro, that is, a train runs back and forth on one side only, which is mainly used in case of unilateral interruption;
- route adjustment, that is, changing a train route, so as to avoid a fault area and allow a train to run normally in a non-fault area, which is applicable to the situation where a station is completely interrupted and there are turn-back stations in a non-interruption zone; and
- a combination mode, that is, using unilateral to-and-fro and route adjustment flexibly according to different interruption area structures, which is suitable for complex line structures.

The research on train organization adjustment under line interruption in China mainly focus on the research of emergency plans. Every time a train turns back during route adjustment, manual operation is required, and dependence on human experience leads to errors easily. Therefore, automation of route adjustment has become a research focus. Many achievements have been made in the automation of equal-interval turn-back, but the research on how to match an original operation diagram plan after route adjustment is still in the initial stage.

It is found through searching that China Patent No. CN10860903A discloses an automatic turn-back control method for unmanned trains, and China Patent No. CN110936987A discloses a full-automatic turn-back control method for urban rail transit trains, both of which are automatic turn-back control technologies used in the process of automatic driving. However, neither of the two patents mentions the change of turn-back lines in case of interruption, so how to quickly and effectively change a turn-back point in case of interruption becomes a technical problem to be solved.

SUMMARY OF INVENTION

In order to overcome the defects in the prior art, the invention provides an operation diagram-based method for automatically changing a route to turn back in case of interruption.

The purpose of the invention can be realized by the following technical scheme.

According to one aspect of the invention, an operation diagram-based method for automatically changing a route to turn back in case of interruption is provided. The method obtains an alternative turn-back point according to the position of a fault point and the information of a line turn-back station, calculates a corresponding turn-back plan of the alternative turn-back point according to an operation diagram of the current day, and finally automatically changes an online train route according to the new turn-back plan, so as to realize automatic turn-back of a train after route adjustment in case of interruption.

As a preferred technical scheme, the method comprises the following steps:

- step $S_1$) inputting fault position information, original operation diagram plan information and line station type diagram information;
- step $S_2$) finding an affected original planned route, the alternative turn-back point and an alternative route according to the information input in step $S_1$;
- step $S_3$) obtaining a departure interval of the alternative route obtained in step $S_2$ according to a planned interval of the original planned route;
- step $S_4$) calculating a turn-back time of the alternative route according to the departure interval of the alternative route obtained in step $S_3$;
- step $S_5$) making a matched new turn-back plan for an online train according to the original operation diagram planned time and the position of the online train input in step $S_1$;
- step $S_6$) updating a running path of the online train according to the new turn-back plan obtained in step $S_5$;
- step $S_7$) conducting turn-back number changing according to the turn-back plan obtained in $S_5$ after the online train with route changed in step $S_6$ reaches the alternative turn-back point; and
- step $S_8$) after the online train arrives at another terminal of the alternative route, if the terminal is a non-alternative turn-back point, turning back according to a planned train number obtained after number changing in step $S_7$.

As a preferred technical scheme, step $S_2$ specifically comprises:

- step $S_{21}$, finding a platform affected by the fault according to the fault position information input in step $S_1$, and then obtaining the affected original planned route;
- step $S_{22}$, searching for a nearest turn-back platform at both ends of a fault area according to the fault position information input in step $S_1$ to obtain the alternative turn-back point; and
- step $S_{23}$, searching for the alternative route according to the alternative turn-back point of step $S_{22}$ and the original planned route of step $S_{21}$.

As a preferred technical scheme, step $S_4$ specifically comprises: step $S_{41}$) determining whether there are multiple routes at the alternative turn-back point, and calculating the constraint relationship between the routes if yes; and step $S_{42}$) for a multi-route turn-back point, calculating a turn-back time according to the constraint relationship obtained in step $S_{41}$, and for a single-route turn-back point, using a default turn-back time.

As a preferred technical scheme, in step $S_{41}$, specifically, assuming that there are n routes at the alternative turn-back point A, the running cycle of the route n is $T_{full\ cycle\ n}=T_{turnback\ n}+T_{operation\ n}$, where $T_{operation\ n}$ is the to-and-fro time except turn-back, $T_{turnback\ n}$ is the turn-back time of the turn-back point A, the departure interval is $T_{interval\ n}$, and the number of trains required for the route n is $N_{train\ n}=T_{full\ cycle\ n}/T_{interval\ n}$; and after route changing, the online train runs according to the original planned time, that is, the original planned to-and-fro running time except turn-back is $T_{operation\ n}=T_{plan\ n}$, and the following constraint relationship is obtained:

$$N_{train\ n}/N_{train\ n-1}=(T_{turnback\ n}+T_{plan\ n})*T_{interval\ n-1}/(T_{turnback\ n-1}+T_{plan\ n-1})*T_{interval\ n}.$$

As a preferred technical scheme, step $S_5$ specifically comprises:

step $S_{51}$, calculating an arrival plan of the alternative turn-back point;

step $S_{52}$, calculating the time when the online train arrives at the alternative turn-back point after route changing; and step $S_{53}$, according to the time obtained in step $S_{52}$ and the arrival plan of the alternative turn-back point obtained in step $S_{51}$, making a matched turn-back plan for the online train based on time.

As a preferred technical scheme, the step $S_{51}$ is based on the passenger on/off time of the original operation diagram input in step $S_1$ and the turn-back time of the alternative turn-back point obtained in step $S_4$.

As a preferred technical scheme, the method comprises keeping the compatibility with the existing operation diagram.

As a preferred technical scheme, in case of interruption, the method comprises automatically changing a train route for a zone with turn-back conditions, so that the train runs in a non-fault zone as planned.

As a preferred technical scheme, the method comprises automatically generating a turn-back plan of the alternative turn-back point according to the position of the online train.

Compared with the prior art, the invention has the following advantages.

1) The invention provides an operation diagram-based adjustment method in case of line interruption, which is different from an existing equal-interval adjustment method in that it keeps the compatibility with an existing operation diagram, so as to facilitate quick recovery of planned operation after a fault is removed.

2) The invention automatically searches for an alternative turn-back point and generates a running route according to a fault position and a line structure, which can effectively reduce manual work.

3) The invention automatically generates a turn-back plan of the alternative turn-back point according to the position of an online train, without excessively relying on manual experience.

BRIEF DESCRIPTION OF DRAWINGS

FIGURE is a flowchart of the invention.

DESCRIPTION OF EMBODIMENTS

Hereinafter, the technical scheme in the embodiments of the invention will be described clearly and completely with reference to the drawings in the embodiments of the invention. Obviously, the described embodiments are only part of the embodiments of the invention, not all of the embodiments. Based on the embodiments of the invention, all other embodiments obtained by those of ordinary skill in the art without creative labor are within the scope of the invention.

The invention provides an operation diagram-based method for automatically changing a route to turn back in case of interruption. In case of interruption, the method automatically changes a train route for a zone with turn-back conditions, so that the train runs in a non-fault zone as planned.

The invention specifically comprises the following steps:

step $S_1$, inputting fault position information, original operation diagram plan information and line station type diagram information;

step $S_2$, finding an affected original planned route, the alternative turn-back point and an alternative route according to information such as the fault position input in step $S_1$;

step $S_3$, obtaining a departure interval of the alternative route obtained in step $S_2$ according to a planned interval of the original planned route;

step $S_4$, calculating a turn-back time of the alternative route according to the departure interval of the alternative route obtained in step $S_3$;

step $S_5$, making a matched new turn-back plan for an online train according to the original operation diagram planned time and the position of the online train input in step $S_1$;

step $S_6$, updating a running path of the online train according to the plan obtained in step $S_5$;

step $S_7$, conducting turn-back number changing according to the turn-back plan obtained in $S_5$ after the train with route changed in step $S_6$ reaches the alternative turn-back point; and step $S_8$, after the train arrives at a non-alternative turn-back point of the alternative route, turning back according to a planned train number obtained in step $S_7$.

The step $S_2$ specifically comprises:

step $S_{21}$, finding a platform affected by the fault according to the fault position information input in step $S_1$, and then obtaining the affected original planned route;

step $S_{22}$, searching for a nearest turn-back platform at both ends of a fault area according to the fault position information input in step $S_1$ to obtain the alternative turn-back point; and step $S_{23}$, searching for the alternative route according to the alternative turn-back point of step $S_{22}$ and the original planned route of step $S_{21}$.

The step $S_4$ specifically comprises:

step $S_{41}$, determining whether there are multiple routes at the alternative turn-back point, and calculating the constraint relationship between the routes if yes; and step $S_{42}$, for a multi-route turn-back point, calculating a turn-back time according to the constraint relationship obtained in step $S_{41}$, and for a single-route turn-back point, using a default turn-back time.

In step $S_{41}$, specifically, assuming that there are n routes at the alternative turn-back point A, the running cycle of the route n is $T_{full\ cycle\ n}=T_{turnback\ n}+T_{operation\ n}$, where $T_{operation\ n}$ is the to-and-fro time except turn-back, $T_{turnback\ n}$ is the turn-back time of the turn-back point A, the departure interval is $T_{interval\ n}$, and the number of trains required for the route n is $N_{train\ n}=T_{full\ cycle\ n}/T_{interval\ n}$; and after route changing, the train runs according to the original planned time, that is, the original planned to-and-fro running time except turn-back is $T_{operation\ n}=T_{plan\ n}$, and the following constraint relationship is obtained:

$$N_{train\ n}/N_{train\ n-1}=(T_{turnback\ n}+T_{plan\ n})*T_{interval\ n-1}/(T_{turnback\ n-1}+T_{plan\ n-1})*T_{interval\ n}.$$

The step $S_5$ specifically comprises:

step $S_{51}$, calculating an arrival plan of the alternative turn-back point based on the passenger on/off time of the original operation diagram input in step $S_1$ and the turn-back time of the alternative turn-back point obtained in step $S_4$;

step $S_{52}$, calculating the time when the train arrives at the alternative turn-back point after route changing; and step $S_{53}$, according to the time obtained in step $S_{52}$ and the arrival plan of the alternative turn-back point obtained in step $S_{51}$, making a matched turn-back plan for the online train based on time.

Specific Embodiments

The method of the invention will be described with reference to FIGURE. The method comprises the following steps:

step $S_1$, a fault position G, original operation diagram plan information (including two routes A-B and A-C) and a line station type diagram are input;

step $S_2$, according to the information input in step $S_1$, the fault point G is on an original planned route A-B, and the original planned route cannot directly run to B because of fault interruption of A; turn-back platforms C and D which have the shortest distance are searched for at both ends of the fault point G, C and D are alternative turn-back points, and A-B is decomposed into alternative routes A-$C_{new}$ and D-B;

step $S_3$, a departure interval of the original planned route A-B is $T_{interval\ A-B}$, and after the turn-back point becomes C, a departure interval $T_{interval\ A-C\ new}$ of the alternative route A-$C_{new}$ is equal to $T_{interval\ A-B}$;

step $S_4$, according to the step S3, it can be known that a 1:1 proportional relationship exists between the number of trains required for the route A-$C_{new}$ and the number of trains on A-C, and the constraint relationship is as follows:

$$N_{train\ A-C\ new}/N_{train\ A-C}=(T_{turn-back\ A-C\ new}+T_{operation\ A-C\ new})*T_{interval\ A-C\ new}/(T_{turn-back\ A-C}+T_{operation\ A-C})*T_{interval\ A-C}=1;$$

according to the original operation diagram plan, the proportional relationship between $T_{interval\ A-C\ new}$ and $T_{interval\ A-C}$ can be obtained; assuming $T_{interval\ A-C\ new}/T_{interval\ A-C\ plan}=1$, the turn-back time of the route A-$C_{new}$ at the turn-back point C is $T_{turn-back\ A-C\ new}=T_{turn-back\ A-C}+T_{operation\ A-C}-T_{operation\ A-C\ new}$; assuming that the default turn-back time of the turn-back point D is $T_{D\ default}$, only the route B-$D_{new}$ turns back at the turn-back point D, and it can be known from step $S_3$ that the turn-back time of the route B-$D_{new}$ at the turn-back point C is $T_{turn-back\ D-B}=T_{D\ default}$;

step $S_5$, according to the planned time of the train at the passenger on/off platform closest to the alternative turn-back points C and D and the turn-back time obtained in step $S_4$, the planned arrival time of the turn-back points C and D is calculated, then the estimated time when the online train arrives at the turn-back points C and D is calculated, and a planned number with the closest matching time is allocated to the online train;

step $S_6$, according to the planned number obtained in step $S_5$, the online train running path is updated to A-$C_{new}$ or D-B;

step $S_7$, after the train 1 with the original running route A-B reaches the alternate turn-back points C and D, a departure planned turn-back number obtained in step $S_6$ is 003; and step $S_8$, the train 1 turns back at the turn-back point A according to the planned number 003.

The above are only specific embodiments of the invention, but the protection scope of the invention is not limited thereto. Any person familiar with the technical field can easily think of various equivalent modifications or substitutions within the technical scope disclosed by the invention, and these modifications or substitutions should fall within the protection scope of the invention. Therefore, the protection scope of the invention shall be subject to the protection scope of the claims.

What is claimed is:

1. An operation diagram-based method for automatically changing a route to turn back in case of interruption, wherein the method comprises: obtaining an alternative turn-back point according to a position of a fault point and information of a line turn-back station, calculating a corresponding turn-back plan of the alternative turn-back point according to an operation diagram of a current day, and finally automatically changing an online train route according to a new turn-back plan, so as to realize automatic turn-back of a train after route adjustment in case of interruption, wherein the method comprises following steps:

step $S_1$) inputting fault position information, original operation diagram plan information and line station type diagram information;

step $S_2$) finding an affected original planned route, the alternative turn-back point and an alternative route according to information input in step $S_1$;

step $S_3$) obtaining a departure interval of the alternative route obtained in step $S_2$ according to a planned interval of the original planned route;

step $S_4$) calculating a turn-back time of the alternative route according to the departure interval of the alternative route obtained in step $S_3$;

step $S_5$) making a matched new turn-back plan for an online train according to original operation diagram planned time and a position of the online train input in step $S_1$;

step $S_6$) updating a running path of the online train according to the new turn-back plan obtained in step $S_5$;

step $S_7$) conducting turn-back number changing according to the turn-back plan obtained in step $S_5$ after the online train with route changed in step $S_6$ reaches the alternative turn-back point; and step $S_8$) after the online train arrives at another terminal of the alternative route, if the another terminal is a non-alternative turn-back point, turning back according to a planned train number obtained after number changing in step $S_7$.

2. The operation diagram-based method for automatically changing a route to turn back in case of interruption according to claim 1, wherein step $S_2$ specifically comprises:

step $S_{21}$, finding a platform affected by fault according to the fault position information input in step $S_1$, and then obtaining the affected original planned route;

step $S_{22}$, searching for a nearest turn-back platform at both ends of a fault area according to the fault position information input in step $S_1$ to obtain the alternative turn-back point; and step $S_{23}$, searching for the alternative route according to the alternative turn-back point of step $S_{22}$ and the original planned route of step $S_{21}$.

3. The operation diagram-based method for automatically changing a route to turn back in case of interruption according to claim 1, wherein step $S_4$ specifically comprises:

step $S_{41}$) determining whether there are multiple routes at the alternative turn-back point, and calculating constraint relationship between the routes if yes; and step $S_{42}$) for a multi-route turn-back point, calculating a turn-back time according to the constraint relationship obtained in step $S_{41}$, and for a single-route turn-back point, using a default turn-back time.

4. The operation diagram-based method for automatically changing a route to turn back in case of interruption according to claim 3, wherein step $S_{41}$, specifically comprises:

assuming that there are n routes at the alternative turn-back point A, a running cycle of the route n is $T_{full\ cycle\ n}=T_{turnback\ n}+T_{operation\ n}$, where $T_{operation\ n}$ is to-and-fro time except turn-back, $T_{turnback\ n}$ is turn-back time of the turn-back point A, a departure interval is $T_{interval\ n}$, and a number of trains required for the route n is $N_{train\ n}=T_{full\ cycle\ n}/T_{interval\ n}$; and after route changing, the online train runs according to original planned time, that is, original planned to-and-fro running time except turn-back is $T_{operation\ n}=T_{plan\ n}$, and following constraint relationship is obtained:

$$N_{train\ n}/N_{train\ n}-1=(T_{turn\text{-}back\ n}+T_{plan\ n})*T_{interval\ n\text{-}1}/(T_{turn\text{-}back\ n\text{-}1}+T_{plan\ n\text{-}1})*T_{interval\ n}.$$

5. The operation diagram-based method for automatically changing a route to turn back in case of interruption according to claim 1, wherein step $S_5$ specifically comprises:

step $S_{51}$, calculating an arrival plan of the alternative turn-back point;

step $S_{52}$, calculating time when the online train arrives at the alternative turn-back point after route changing; and step $S_{53}$, according to the time obtained in step $S_{52}$ and the arrival plan of the alternative turn-back point obtained in step $S_{51}$, making a matched turn-back plan for the online train based on time.

6. The operation diagram-based method for automatically changing a route to turn back in case of interruption according to claim 5, wherein the step $S_{51}$ is based on passenger on/off time of original operation diagram input in step $S_1$ and the turn-back time of the alternative turn-back point obtained in step $S_4$.

7. The operation diagram-based method for automatically changing a route to turn back in case of interruption according to claim 1, wherein the method comprises keeping compatibility with existing operation diagram.

8. The operation diagram-based method for automatically changing a route to turn back in case of interruption according to claim 1, wherein in case of interruption, the method comprises automatically changing a train route for a zone with turn-back conditions, so that the online train runs in a non-fault zone as planned.

9. The operation diagram-based method for automatically changing a route to turn back in case of interruption according to claim 1, wherein the method comprises automatically generating a turn-back plan of the alternative turn-back point according to a position of an online train.

* * * * *